US011826877B2

(12) United States Patent
Wang

(10) Patent No.: US 11,826,877 B2
(45) Date of Patent: Nov. 28, 2023

(54) WHEEL GRINDER

(71) Applicant: Long-Wei Wang, Taichung (TW)

(72) Inventor: Long-Wei Wang, Taichung (TW)

( * ) Notice: Subject to any disclaimer, the term of this patent is extended or adjusted under 35 U.S.C. 154(b) by 1012 days.

(21) Appl. No.: 16/721,945

(22) Filed: Dec. 20, 2019

(65) Prior Publication Data

US 2021/0187694 A1 Jun. 24, 2021

(51) Int. Cl.
*B24B 41/06* (2012.01)
*B24B 55/04* (2006.01)
*B24B 27/00* (2006.01)

(52) U.S. Cl.
CPC ..... *B24B 41/06* (2013.01); *B24B 27/0007* (2013.01); *B24B 55/04* (2013.01)

(58) Field of Classification Search
CPC .. B24B 21/18; B24B 7/28; B24B 7/06; B24B 7/07; B24B 7/075; B24B 7/08; B24B 55/00; B24D 9/04
USPC ..... 451/120, 124, 130, 131, 139, 150
See application file for complete search history.

(56) References Cited

U.S. PATENT DOCUMENTS 4,436,126 A * 3/1984 Lawson ..... B27C 1/04 144/130
5,421,126 A * 6/1995 Strege ..... B24B 21/002 451/301
5,829,498 A * 11/1998 Liao ..... B27C 1/04 144/130
5,842,913 A * 12/1998 Nemazi ..... B24B 7/28 451/496
6,089,958 A * 7/2000 Costa ..... B24B 21/22 451/300
6,123,125 A * 9/2000 Liao ..... B27C 1/14 33/628
6,283,180 B1 * 9/2001 Chiang ..... B27C 1/14 33/791
6,289,950 B1 * 9/2001 Chiang ..... B27C 1/04 226/193
7,422,515 B1 * 9/2008 Chang ..... B24B 21/20 451/300

* cited by examiner

*Primary Examiner* — Joel D Crandall

(57) ABSTRACT

A wheel grinder contains: a body, a work table, a vertical limitation frame, a movable adjustment portion configured to move vertically, a grinding wheel portion extending outward from the movable adjustment portion, and a motor fixed on the movable adjustment portion. The vertical limitation frame has two fixing holders, two mountings, and two first screw rods and two second screw rods which are inserted through the two mountings respectively and abut against a bottom of the movable adjustment portion. In addition, a stop cover is covered on the grinding wheel portion and includes a defining plate configured to define a connection shaft and an opening inside the defining plate.

2 Claims, 8 Drawing Sheets

WHEEL GRINDER

FIELD OF THE INVENTION

The present invention relates to a wheel grinder in which a movable adjustment portion is adjustable so that the wheel grinder grinds a workpiece accurately.

BACKGROUND OF THE INVENTION

A conventional wheel grinder contains an operation portion and a work table fixed parallel to the operation portion, but they cannot grind a workpiece arcuately because a working error occurs. Thus, it is necessary to provide a movable adjustment portion onto the conventional wheel grinder.

The present invention has arisen to mitigate and/or obviate the afore-described disadvantages.

SUMMARY OF THE INVENTION

The primary aspect of the present invention is to provide a wheel grinder in which a movable adjustment portion is adjustable so that the wheel grinder grinds a workpiece accurately.

Another aspect of the present invention is to provide a wheel grinder which contains a stop cover so that after the wheel grinder grinds the workpiece to produce grinding dusts, the grinding dusts are collected inside the defining plate of the stop cover so as to be drawn out of the wheel grinder via the opening of the stop cover.

To obtain above-mentioned aspects, a wheel grinder provided by the present invention contains: a body, a work table, a vertical limitation frame connected on a rear side of the work table, a movable adjustment portion configured to move vertically and accommodated in the vertical limitation frame, a grinding wheel portion extending outward from a front side of the movable adjustment portion, and a motor fixed on a rear side of the movable adjustment portion.

The vertical limitation frame has two fixing holders arranged on two sides of a bottom of the vertical limitation frame respectively, two mountings locked beside the two fixing holders respectively, and two first screw rods and two second screw rods which are inserted through the two mountings respectively and abut against a bottom of the movable adjustment portion.

In addition, a stop cover is covered on the grinding wheel portion and includes a defining plate configured to define a connection shaft and an opening inside the defining plate.

DETAILED DESCRIPTION OF THE PREFERRED EMBODIMENTS

Figure 1:
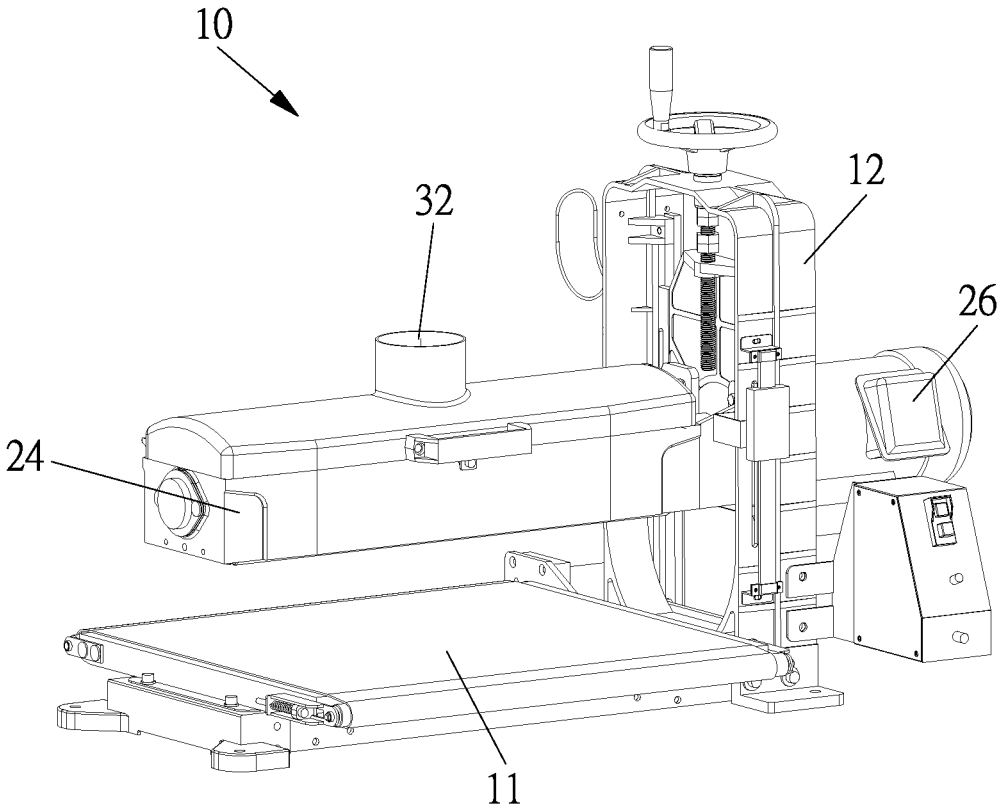
FIG. 1 is a perspective view showing the assembly of a wheel grinder according to a preferred embodiment of the present invention.
Figure 2:
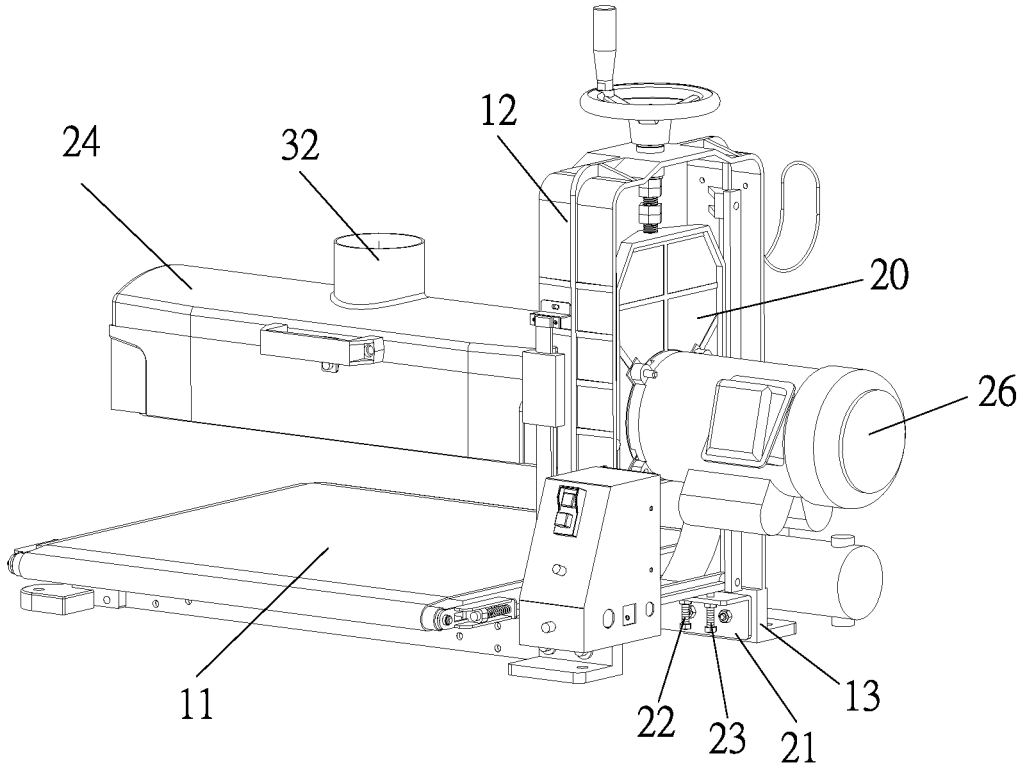
FIG. 2 is another perspective view showing the assembly of the wheel grinder according to the preferred embodiment of the present invention.
Figure 3:
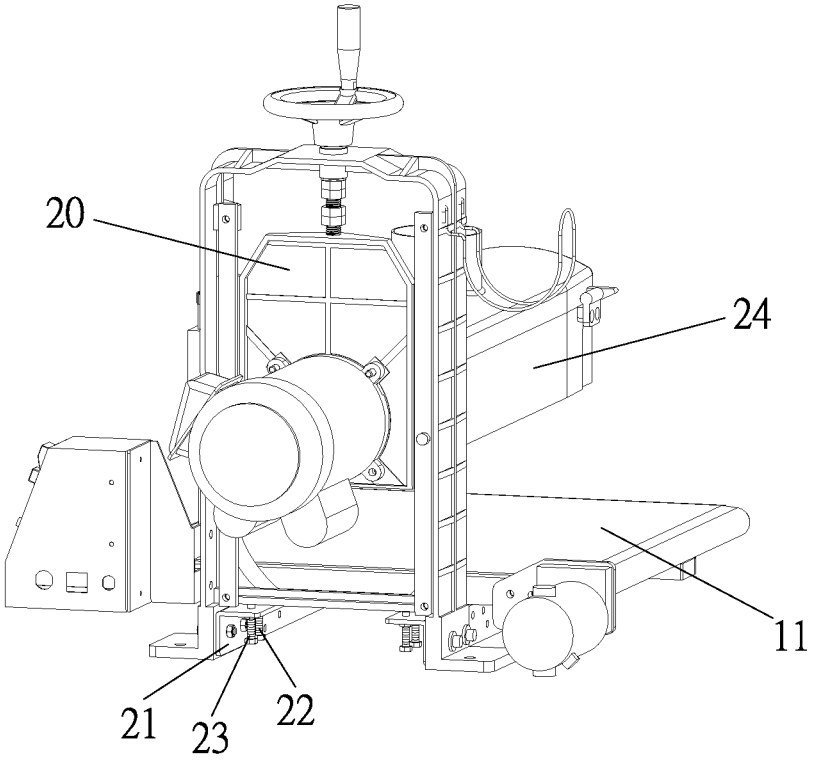
FIG. 3 is also another perspective view showing the assembly of the wheel grinder according to the preferred embodiment of the present invention.

With reference to FIGS. 1-3, a wheel grinder according to a preferred embodiment of the present invention comprises: a body 10, a work table 11, a vertical limitation frame 12 connected on a rear side of the work table 11, a movable adjustment portion 20 configured to move vertically and accommodated in the vertical limitation frame 12, a grinding wheel portion 24 extending outward from a front side of the movable adjustment portion 20, and a motor 26 fixed on a rear side of the movable adjustment portion 20, wherein the grinding wheel portion 24, the movable adjustment portion 20, and the motor 26 form an operation structure of the wheel grinder.

The vertical limitation frame 12 has two fixing holders 13 arranged on two sides of a bottom of the vertical limitation frame 12 respectively, two mountings 21 locked beside the two fixing holders 13 respectively, and two first screw rods 22 and two second screw rods 23 which are inserted through the two mountings 21 respectively and abut against a bottom of the movable adjustment portion 20.

Figure 4:
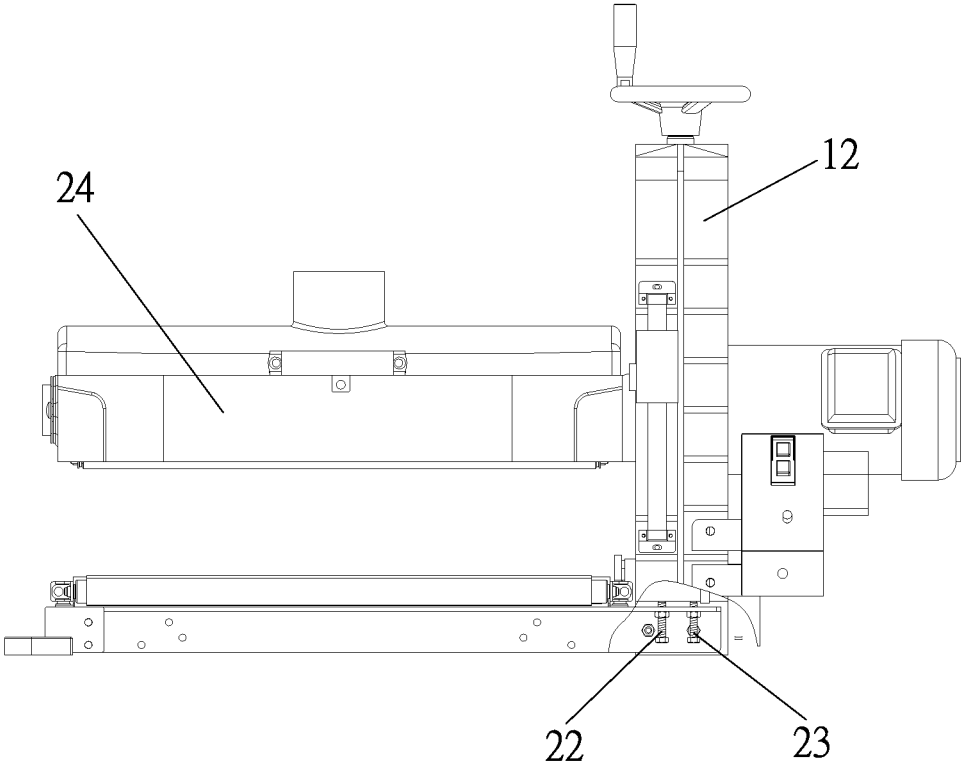
FIG. 4 is a side plan view showing the operation of the wheel grinder according to the preferred embodiment of the present invention.
Figure 5:
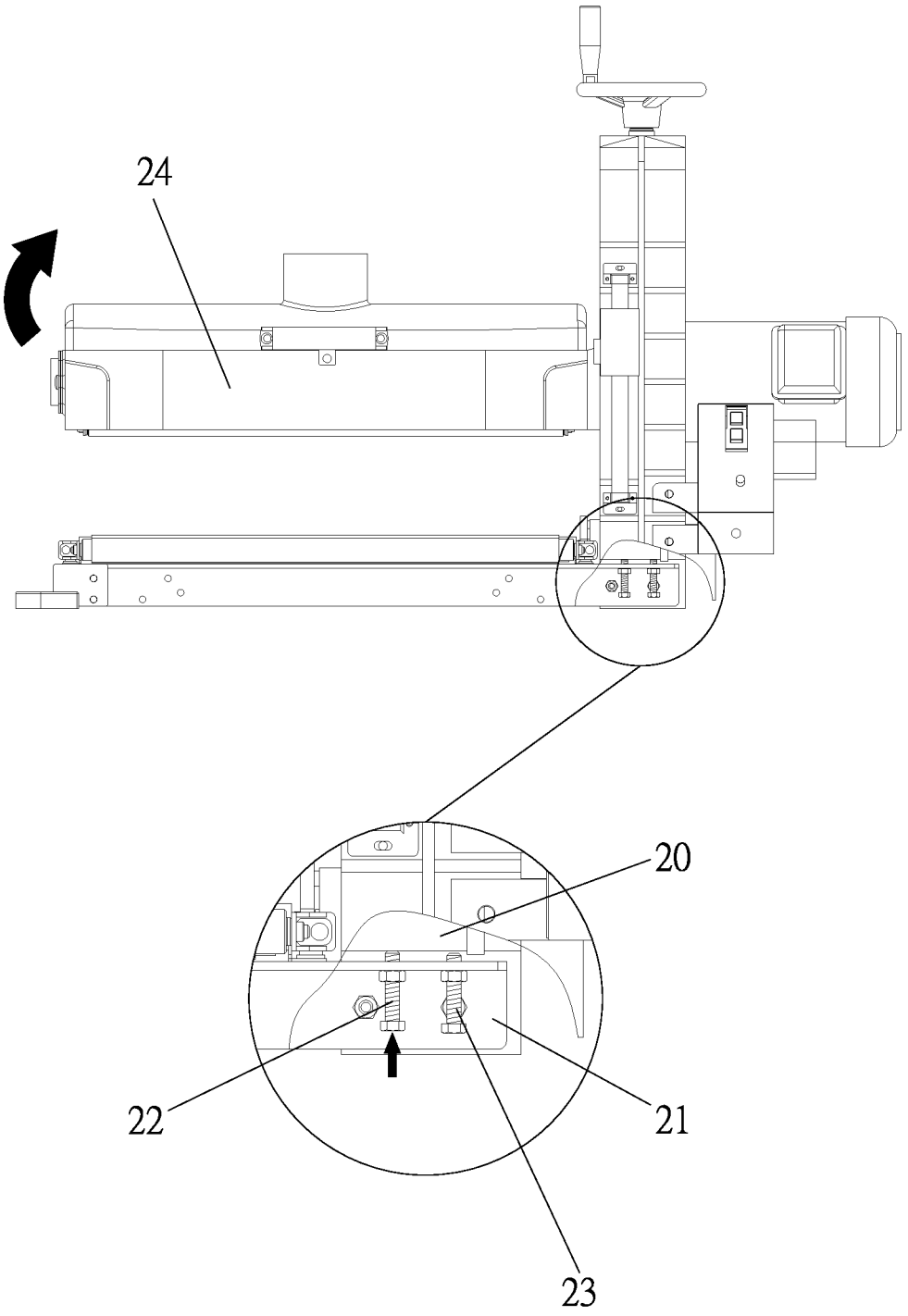
FIG. 5 is another side plan view showing the operation of the wheel grinder according to the preferred embodiment of the present invention.
Figure 6:
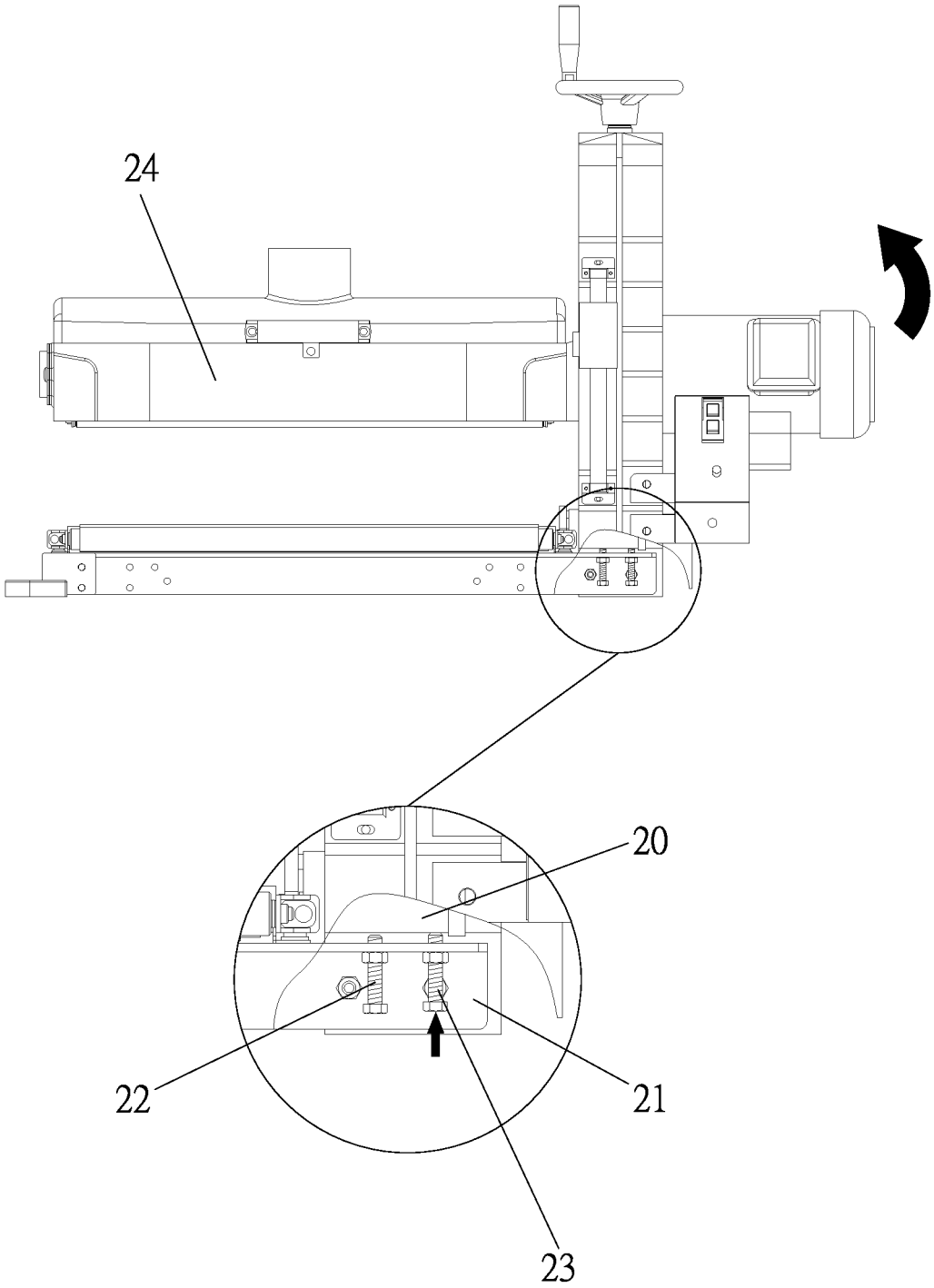
FIG. 6 is also another side plan view showing the operation of the wheel grinder according to the preferred embodiment of the present invention.

Referring to FIGS. 4-6, when the two first screw rods 22 are adjustably moved upward, a front end of the grinding wheel portion 24 tilts upward, and when the two second screw rods 23 are adjustably moved upward, a rear end of the grinding wheel portion 24 tilts upward, such that the two first screw rods 22 or the two second screw rods 23 are adjustably moved upward so that the grinding wheel portion 24 tilts forward or rearward to grind a workpiece accurately.

Figure 7:
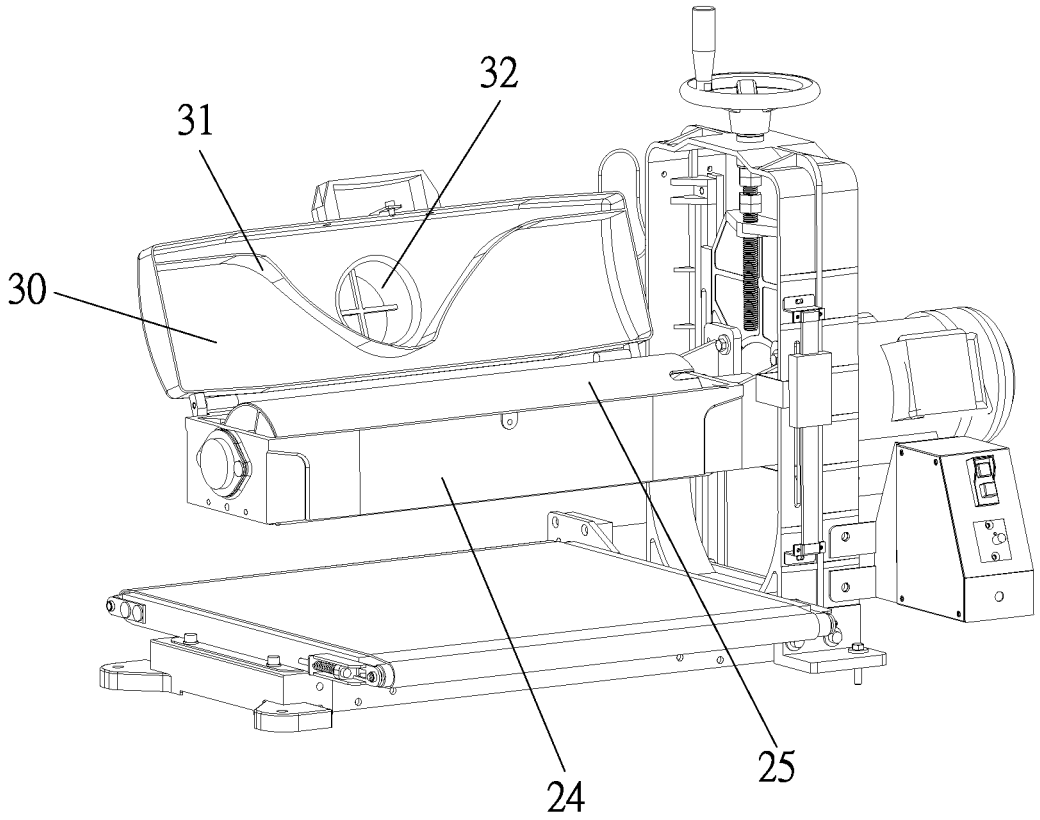
FIG. 7 is still another perspective view showing the assembly of the wheel grinder according to the preferred embodiment of the present invention.
Figure 8:
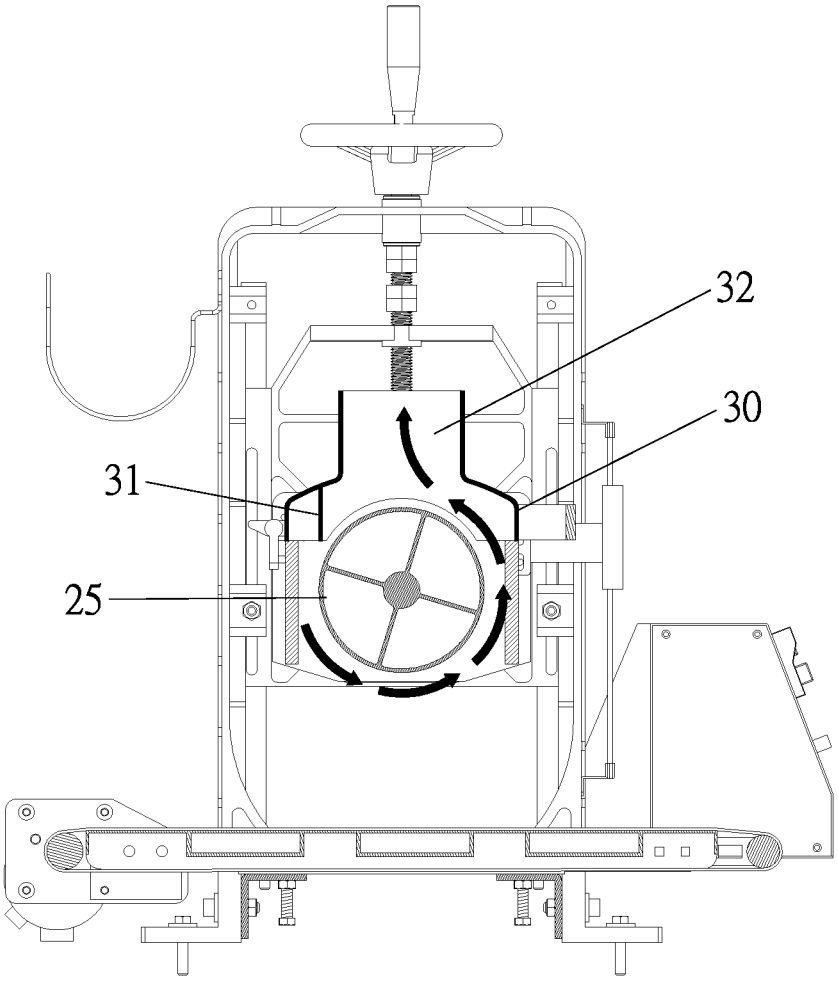
FIG. 8 is a cross sectional view showing the assembly of a part of the wheel grinder according to the preferred embodiment of the present invention.

As shown in FIGS. 7 and 8, a stop cover 30 is covered on the grinding wheel portion 24 and includes a defining plate 31 configured to define a connection shaft 25 and an opening 32 inside the defining plate 31 so that after the wheel grinder grinds the workpiece to produce grinding dusts, the grinding dusts are collected inside the defining plate 31 so as to be drawn out of the wheel grinder via the opening 32.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A wheel grinder comprising: work table, a vertical limitation frame connected on a rear side of the work table, a movable adjustment portion configured to move vertically and accommodated in the vertical limitation frame, a grinding wheel portion extending outward from a front side of the movable adjustment portion, and a motor fixed on a rear side of the movable adjustment portion;

wherein the vertical limitation frame has two fixing holders, each of the two fixing holders arranged on respective sides of a bottom of the vertical limitation frame, two mountings, wherein each of the two mountings are locked beside each of the two fixing holders, respectively, and one of the two first screw rods and one of two second screw rods are inserted through each of the two mountings and configured to abut against a bottom of the movable adjustment portion;

wherein a stop cover is covering on the grinding wheel portion and includes a defining plate configured to not interfere with a connection shaft and an opening inside the defining plate;

wherein when the two first screw rods are adjustably moved upward, a front end of the grinding wheel portion tilts upward; and wherein when the two second screw rods are adjustably moved upward, a rear end of the grinding wheel portion tilts upward.

2. The wheel grinder as claimed in claim 1, wherein after the wheel grinder grinds the workpiece to produce grinding dusts, the grinding dusts are collected inside the defining plate so as to be drawn out of the wheel grinder via the opening.

* * * * *